US005103722A

United States Patent [19]

Brengman et al.

[11] Patent Number: 5,103,722

[45] Date of Patent: Apr. 14, 1992

[54] METHOD AND APPARATUS FOR MARKING METAL PRODUCTS AT INCIPIENT FORMATION TEMPERATURES

[75] Inventors: Keith C. Brengman, Carroll; Frank D. Stephens, Canal Winchester, both of Ohio

[73] Assignee: Artisan Equipment, Inc., Carroll, Ohio

[21] Appl. No.: 586,871

[22] Filed: Sep. 24, 1990

[51] Int. Cl.[5] ..... B41F 17/00

[52] U.S. Cl. ..... 101/35; 101/4

[58] Field of Search ..... 101/35, 4–8, 101/41–44

[56] References Cited

U.S. PATENT DOCUMENTS 4,106,965 8/1978 Lee ..... 101/35

4,506,999 3/1985 Robertson ..... 400/121

FOREIGN PATENT DOCUMENTS 56-46441 11/1981 Japan ..... 101/35

*Primary Examiner*—Edgar S. Burr

*Assistant Examiner*—Ren Yan

*Attorney, Agent, or Firm*—Mueller and Smith

[57] ABSTRACT

A marking apparatus, system and method is described wherein metal products such as steel billets, blooms, and slabs are marked for identification essentially as they issue from the throat of a casting system and are at elevated temperatures. The apparatus includes a cutter having abrasive cutting components which forms a groove in the rough cut end surface of the metal components, the formation of which immediately is followed by the movement of a driven pin indentation type marking apparatus along the thus-formed slot. Positioning of the metal component is provided by a clamp structure which initially functions to decelerate the component as it moves along a casting table and then to clamp it into position for marking. The apparatus is designed to carry out the entire marking procedure within the short window of available time typically encountered in a continuous casting process.

32 Claims, 11 Drawing Sheets

10
12

25
26
24
22
50
14
46
40
38
16
18
19
20
40
44
16
32
32
32
40
40
16
42
36
16
40
52
48
54
34a
34b
34c
68a
68b
68c
70a
70b
70c
64a
30a
66a
64b
66b
64c
66c
30b
30c 5
56
80
82
148
140
30
118
88
96
86
176
94
94
180
68
34
58
92
5
178
194
158
162
160
222
70
220
224
166
226
164
64
66

START CYCLE
390
392
394
CARRIAGE UP LS
396
READY FOR NEXT BILLET
398
400
N
Y
408
402
410
CLAMP 92 UP LS
412
N
Y
414
406
CHECK STATUS SCREEN
ALLOW BILLET TO ENTER
416
404
418
420
BILLET SENCED
422
N
Y
426
424
ACTUATE CLAMP 92
428
INHIBIT PUSHER 36
430
432
434
CLAMP 92 DOWN LS
436
N
Y
438

METHOD AND APPARATUS FOR MARKING METAL PRODUCTS AT INCIPIENT FORMATION TEMPERATURES

BACKGROUND

A broadening variety of manufactured metal components intended for more critical machine or structural tasks are the subject of a form of fabrication monitoring. For this purpose, it is necessary for the industrial fabricator to enjoy the capability of tracing the fabrication history of a metal component to the formation of the metal from which it was formed. For the case of steel, it is necessary that the original metallurgical properties of a heat or cast be confirmable with a very high level of reliability. To achieve such requisite assurances, a variety of marking approaches have been employed to identify metal essentially from the point in time when it transitions from a liquid to a solid phase.

In general, the initial metallurgical properties of the metal are identified in the melt shop of a steel mill as a cast number or heat number. In a continuous steel casting system, the molten metal of a given heat is cast in one of three basic forms, to wit, billets, blooms, and slabs. Typically a billet is between about 5 and 8 inches square and is directed from the appropriate rolls and the like of a casting facility in a sequence of continuous strands are expelled onto a run-out table under high temperature conditions, for example about 2000° F., whereupon they are cut into discrete components of lengths, for example, of about 17 feet. These strands extend to an end stop of the run-out table, whereupon they are moved by a pusher to a position where they are picked-up by a crane and located under careful inventory control in a storage area. Blooms generally are of larger cross-sectional area, ranging for example from 8 to 24 inches square, while slabs are generally cast as being about 8 inches thick and from 24 to 80 inches wide. The storage region in which these cast components are located is accessed by a crane at such time as an order for a particular form of steel is desired. The component is identified both by a marking and by inventory positional control before being placed upon a charging table to be reheated and rolled into a final shape specified by the industrial customer. Where a failure in marking or identification occurs, application specific metallurgical properties of the component come into question calling for the component to be returned to inventory and identified as a lower grade component, a procedure necessary for such circumstances and expensive.

To assure reliable identification, it is necessary that marking be carried out as the steel components are expelled onto the charging table, an environment and condition of highly difficult marking. For example, in general, a 22 second window of time is available to the marking apparatus or individual to carry out marking. Further, the steel components will be at the noted elevated temperature. Where marking occurs on the end surface of the component, such marking must be carried out on a very rough surface formed in the course of flame-cutting the components into given lengths.

Traditionally, automated marking devices have included a rotary head stamper carrying discrete characters which is thrust with substantial force into the surface of the steel. Alternately, a very large and difficult to handle device carrying a magazine of wheels, each ratchet driven and each carrying identifying characters such as numbers are positioned over the steel and are impacted to drive the numbers into the rough end surfaces of the steel components. Such machines are prone to damage due to the forces in the environment involved. As another approach, stainless steel metal tags having abrasive coatings and printed indicia formed with high temperature inks may be attached to the steel on the casting table. However, such devices are prone to fall off, a condition causing loss of the component due to loss of identification. Chalk has been used to mark the steel components, however, as the steel cools, surface oxidation occurs and a scale develops, whereby such numbering or identification is lost. Other manual approaches are with a numeric die and a hammer, a technique not desirable for identification. Another approach has been to "write" upon the steel surface utilizing a metallic spray, for example formed of bronze and aluminum. This form of marking, however, requires that the metal component be descaled prior to the marking procedure, an undesirable requirement.

Over the recent past, a computer driven marking system wherein dot matrix characters are formed by a linear array of pneumatically driven marking pins has been developed by Robertson. With this system, a very high speed marking of characters can be carried out under rigorous environmental conditions as are encountered in a steel mill environment. Such marking systems are described, for example, in U.S. Pat. No. 4,506,999 by Robertson, entitled "Program Controlled Pin Matrix Embossing Apparatus" and in U.S. Pat. No. 4,808,018 by Robertson, entitled "Marking Apparatus with Matrix Defining Locus of Movement". Marketed under the trademark "PINSTAMP", the marking system has been found to be capable of marking indentation defined dot matrix characters on the rough cut end surface of billets and the like, however, the rugged surfaces pose a visual noise which renders the characters difficult to man read.

SUMMARY

The present invention is addressed to an improved method, apparatus and system for marking metal components while at elevated incipient temperatures associated with the formation of such metal components. Outfitted with a milling cutter component to provide a smooth, scale-free groove in which to apply dot matrix indicia, the invention provides for consistently applied marks on irregularly surfaced metal components soon after their taking shape. The milling of a marking groove characteristic thus provided permits cost effective, computer-controlled component marking devices to be implemented at earlier stages in the component forming process than heretofore feasible, providing for greater confidence in tracing a component to its metallurgical source.

The invention further features an apparatus for marking a given surface of metal components at elevated temperatures as they are transferred to a receiving region having a terminus which includes a stop assembly positioned adjacent the receiving region terminus for receiving the metal component in adjacency to position the given surface at a marking location. A carriage assembly is mounted in spaced adjacency to the stop assembly and is movable along the marking location between first and second positions. A milling cutter is mounted upon and movable with the carriage assembly and has a movable cutter component of predetermined width which is operably engageable with the given surface when the carriage assembly is moved from its first to its second positions to form a marking groove therein, when actuated, having a substantially uniform marking surface. A marking assembly is mounted upon the carriage assembly and is movable therewith along the marking location and is actuable for marking predetermined indicia upon the marking surface. A drive arrangement is actuable for effecting the carriage assembly movement and a control is provided for selectively actuating the drive assembly, the milling cutter, and the marker assembly.

Another feature of the invention provides a method of marking metal components while at elevated temperature of formation. The method comprises the steps of:

providing a marking station at the receiving region;

detecting the presence of a select surface of the metal component at the station;

milling a groove within the selected surface while the metal component is at an elevated temperature, the groove having a predetermined width and a depth selected to form a substantially uniform working surface; and marking the metal component by applying an identifying indicia upon the marking surface.

As another feature, the invention provides a system for marking steel components upon being expressed at a nascent stage of formation at elevated temperature from a continuous casting facility onto a casting table upon which they are cut to predetermined lengths deriving cut end surfaces and wherein they are pushed from the table by actuation of pusher assembly. The system includes a stop assembly positioned at the table at a location for effecting abutting contact with the steel component and for positioning an end surface at a marking location. A carriage assembly is mounted in spaced adjacency to the stop assembly and is movable between the first position at one side of the stop assembly and the second position at an opposite side of the stop assembly. A milling cutter is mounted upon and movable with the carriage assembly and has a movable cutter component of predetermined width. The cutter is actuable for operable engagement with the cut end surface when the carriage assembly is moved from its first to its second position to form a marking groove therein having a substantial uniform marking surface. A marker assembly is mounted upon the carriage assembly which is movable therewith along the milling cutter formed marking groove and which includes an array of marking pins which are actuable for forming predetermined dot matrix defined indicia upon the marking surface. A drive arrangement is actuable for effecting the carriage assembly movement and a control arrangement provides for selectively actuating the drive assembly, the milling cutter, and the array of marking pins.

Other features of the invention will, in part, be obvious and will, in part, appear hereinafter. The invention, accordingly, comprises the apparatus, system, and method possessing the construction, combination of elements, arrangement of parts and steps which are exemplified in the following detailed description.

For a fuller understanding of the nature and objects of the invention, reference should be had to the following detailed description taken in connection with the accompanying drawings.

DETAILED DESCRIPTION

The apparatus, system and method of the instant invention may be employed with a variety of metals and metal components as they issue from a casting environment in a nascent state at elevated temperature. For the purpose of the instant description, the apparatus, system and method are disclosed in conjunction with the formation of steel billets from a continuous casting facility.

Figure 1:
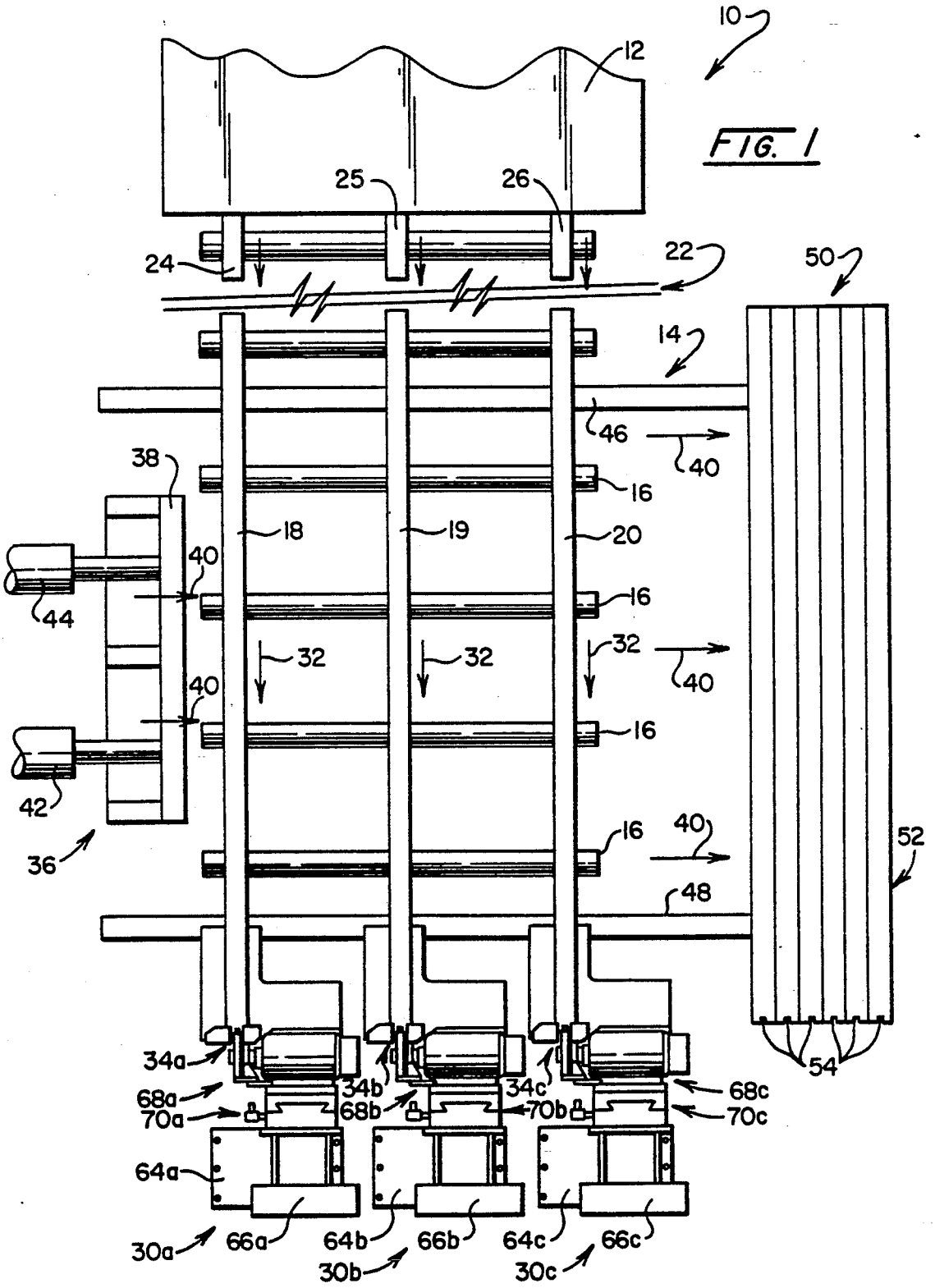
FIG. 1 is a top view of the run-out table region of a billet casting system incorporating three marking devices according to the invention.

Looking to FIG. 1, a casting system according to the invention is illustrated from an overhead perspective, generally at 10. System 10 includes a continuous casting facility 12 which is positioned adjacent the receiving region or run-out table represented generally at 14 comprised of a series of rollers as at 16. The casting facility 12 is seen issuing three continuous strands of billet-shaped material as at 18–20, each of which is cut to desired lengths of, for the example, 17 feet at a cutting station represented schematically by the broken lines at 22. As the billets 18–20 are thus moved from facility 12, they will exhibit elevated temperatures, for example in the range of about 1800° F. to 2000° F. Generally, the ends of the billets representing the cut-off surfaces, for example at 24–26, will engage an end stop structure to halt their movement along the run-out table 14. However, in accordance with the instant invention, the billets as at 18–20 will instead, engage the stop assemblies of marking devices configured in accordance with the invention and represented in general at **30*a*, 30*b*, and 30*c*. Typically, the billets as at 18–20, moving along the direction shown by arrows 32 will have an available residence interval when engaged against the stop assemblies 34*a*–34*c* of respective devices 30*a*–30*c*** of about 22 seconds. It is during this window of time that any marking procedures must be carried out.

Following that relatively short residence interval available for marking, the billets as at 18–20 then are moved out of region 14 by a hydraulic pusher assembly represented generally at 36 and seen to include an elongate abutting structure 38 which is driven in the direction of arrows 40 by hydraulic actuators as at 42 and 44. Structure 38, thus engages the billets 18–20 and moves them out of region 14 to be positioned upon rails 46 and 48 at a transfer station or region represented generally at 50. An assemblage of billets so transferred to transfer station 50 is represented at 52. Note that vertical grooves 54 are seen having been formed in the end surfaces of the billets 52. From transfer station 50, typically a crane removes the billets 52 to a billet storage area representing an inventory from which the billets are then removed for formation into customer specified steel components such as bar stock or the like.

Figure 2:
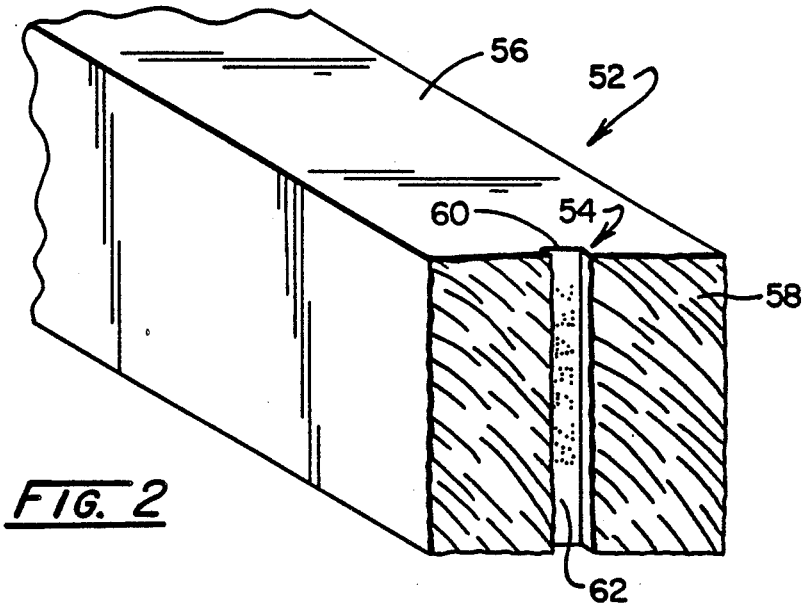
FIG. 2 is a perspective partial view of a billet having been marked by apparatus according to the invention.

Looking additionally to FIG. 2, one billet 56 of the assemblage thereof 52 is revealed having a very rough end surface 58 resulting from the cut-off procedure at cut-off station 22. Within this surface 58, a rectangular marking groove has been formed by one of the marking devices 30*a*–30*c* which includes a bottom marking surface 60 within which have been indented dot matrix type identifying characters or indicia 62. These indicia represent a permanent marking which is readily readable by personnel removing components from inventory. Additionally and importantly, the marking is carried out as an adjunct to the initial formation or issuance of the components 18–20 from the throat of caster 12.

Returning to FIG. 1, each of the marking devices 30*a*–30*c* is seen to include a mounting base as at 64*a*–64*c* above which is seen cabinetry 66*a*–66*c* containing control circuitry readouts and input/output components. The milling and marking components represented generally at 68*a*–68*c* are mounted upon and ride vertically with carriage assemblies shown respectively at 70*a*–70*c*.

In the discourse to follow, looking to the assemblies as at 30*a*–30*c* in detail, the alpha-numerical designation of components as heretofore employed is replaced with only generic numerical identification of components in the interest of clarity. Looking to FIG. 3, a billet, again represented at 56, enters the stop assembly 34 of device 30 while supported upon the rolls as at 16 described in connection with FIG. 1. Device 30 is aligned, as represented in that figure, so as to receive the end face 58 of the billet 56 at stop assembly 34. Stop assembly 34 is formed of an open frame having two parallel spaced upstanding sides 80 and 82, the latter side 82 being seen in FIG. 4. Side components 80 and 82 are supported upon a floor structure formed of beams as at 84. Sides 80 and 82 support an entrance platform formed of horizontal plate 86 and adjacently disposed canted plate 88. The latter plate 88 forms a ramp-like structure for guiding the billet 56 as it approaches the end stop structure 34. An access opening cover 90 for side 80 is shown in FIG. 3.

Figure 3:
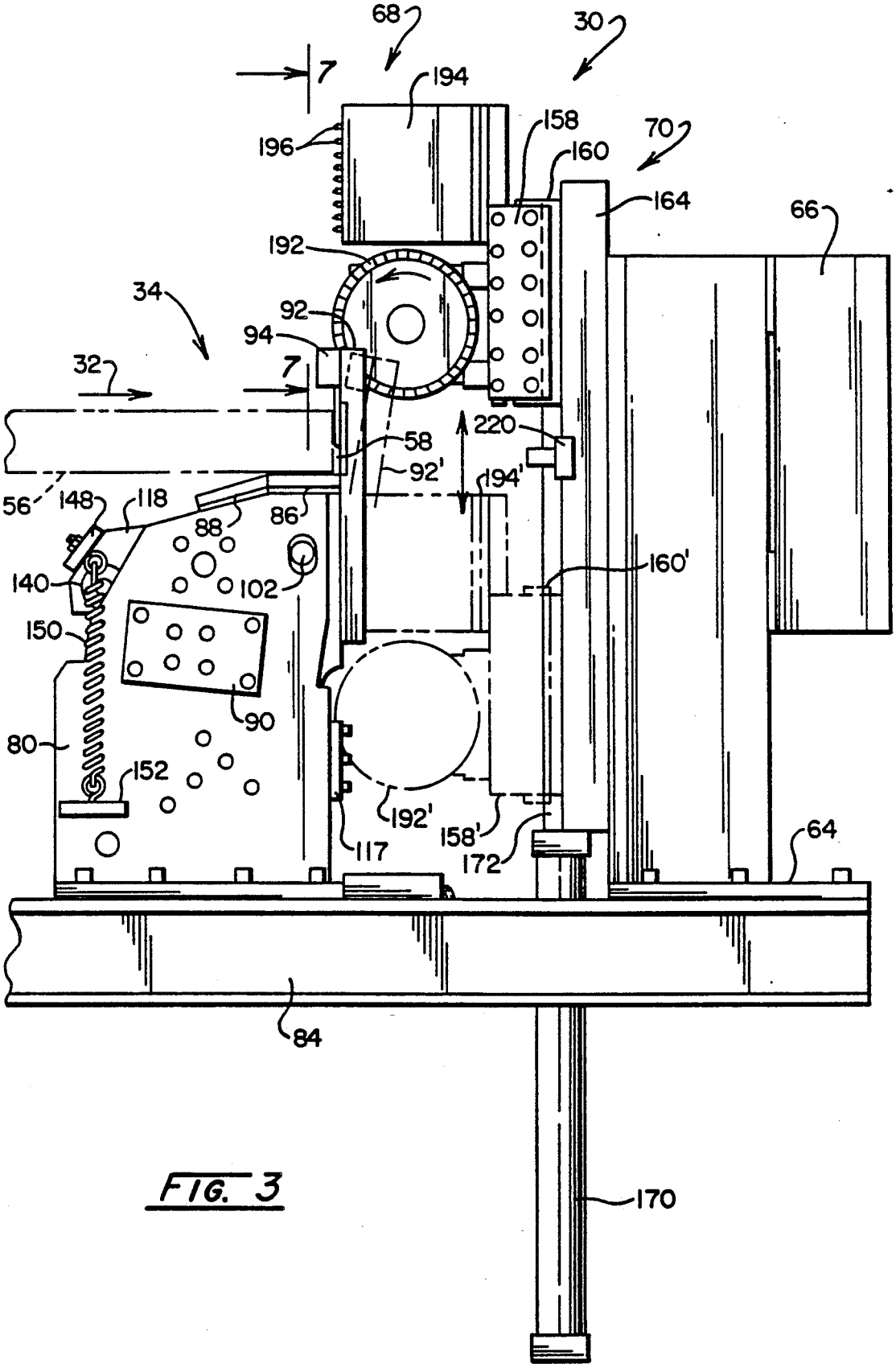
FIG. 3 is a side view of apparatus according to the invention.

End surface 58 of billet 56 is seen positioned in abutting contact with a bifurcate clamp and end stop structure 92 which incorporates a "soft" stopping feature wherein the energy of movement of billets as at 56 in the direction represented by arrow 32 is dissipated by a hydraulic shock absorber as the component 92 pivots to move a small decelerating distance with the billet as represented in phantom in FIG. 3 at 92'. Clamp 92 includes a forwardly-extending gripper portion 94 which, during a clamping procedure, moves downwardly to abuttably engage the upwardly disposed surface of the billets as at 56. The bifurcate shape of the clamp 92 is revealed in FIG. 4 to provide a slot or gap 96 along which the milling and marking components may be moved.

Figure 5:
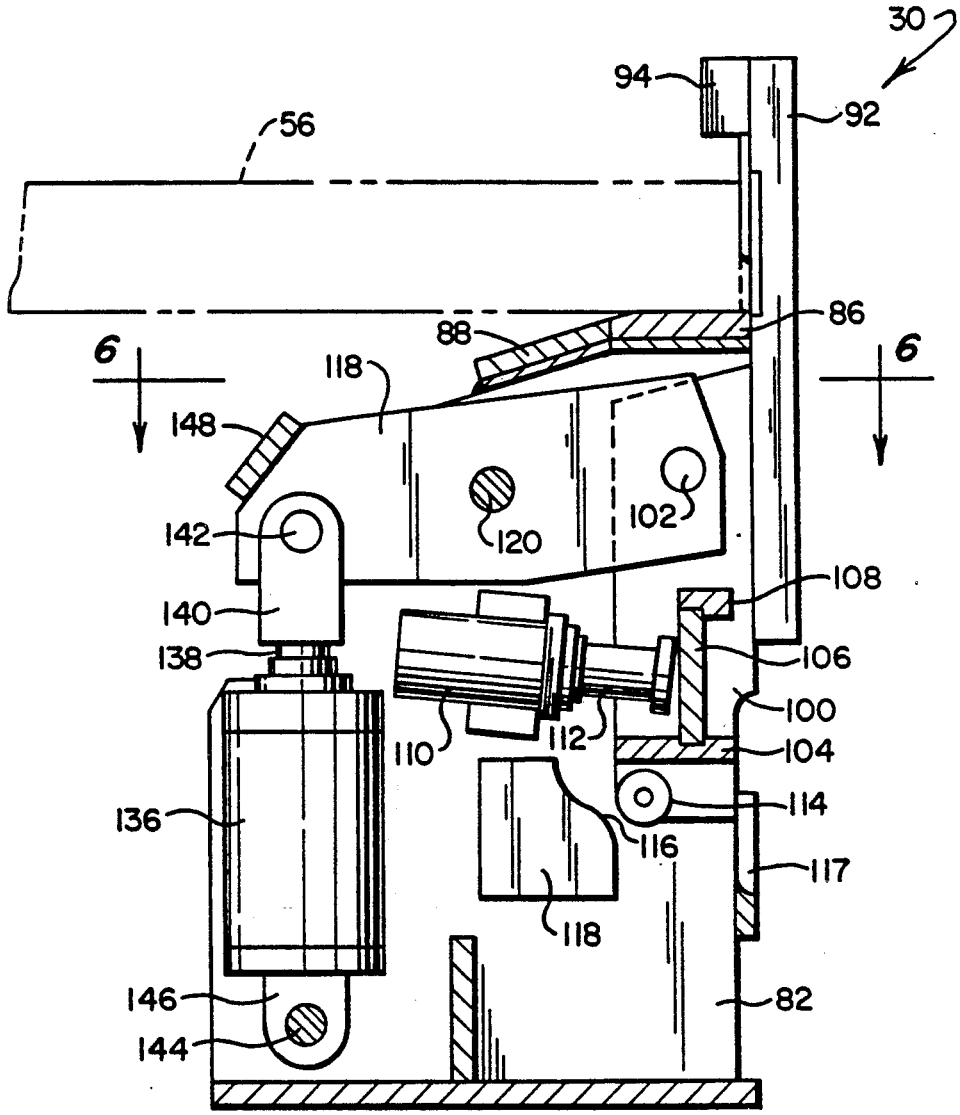
FIG. 5 is a sectional view of apparatus according to the invention taken through the plane 5—5 shown in FIG. 4.
Figure 6:
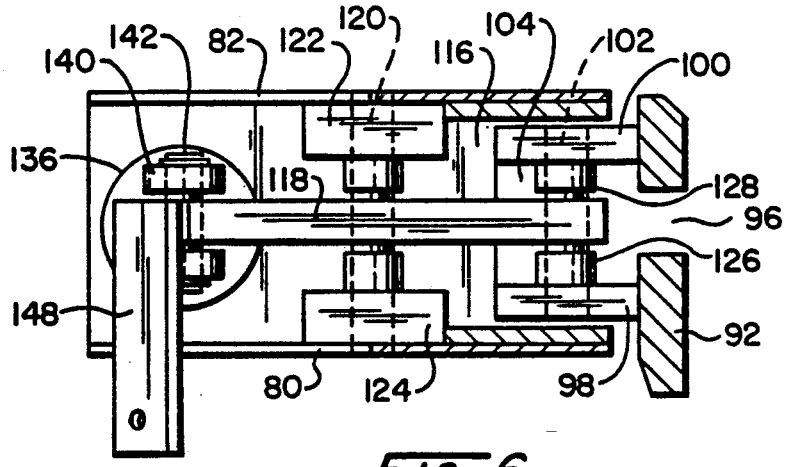
FIG. 6 is a sectional view of apparatus according to the invention taken through the plane 6—6 shown in FIG. 5.

Looking to FIG. 5, the articulated mechanism by which clamp 92 carries out its billet decelerating function and subsequent clamping is revealed. The figure shows the bifurcate clamp 92 components to be pivotally supported by two pivot arms 98 and 100 which, as seen in FIG. 6 are pivoted to side members 80 and 82 about a pin pivot 102. Pivot arms 98 and 100 are interconnected by a horizontally disposed plate 104 from which extends upwardly a striker plate 106 which is, in turn, reinforced by a cross plate 108. As in the case of plate 104, plates 106 and 108 additionally are welded to pivot arms 98 and 100. Abuttably engageable with striker plate 100 is a shock absorber 110 fixed to side 82 and having a shock absorbing piston 112 abuttably engaging striker plate 106, piston 112 having an extended orientation as shown when the bifurcate clamp 92 is in the normal or vertical orientation shown in FIG. 5. Mounted at the lowermost corner of the structure including pivot arms 98 and 100 is a cam roller 114 which is positioned to engage the cammed surface 116 of a cam 118. Thus, as the clamp 92 is driven rearwardly to the orientation 92' as shown in FIG. 3, arms 98 and 100 will pivot about pivot 102 to engage the piston 112 of shock absorber 110. As the pivoting ensues, cam roller 114 will engage the cam surface 116. The pivot 102 about which pivot arms 98 and 100 rotate, in itself, is a portion of an articulated clamping mechanism. In this regard, the pivot pin 102 extends through a clamp pivot arm 118 which, in turn, is mounted for rotational or pivotal movement about a pivot pin 120. FIG. 6 reveals that pivot pin 120 is supported from pin block structures 122 and 124 and that bushings 126 and 128 are employed to aid in the alignment of arm 118 with respect to the dual arms 98 and 100 of the clamping structure. The opposite end of the clamp pivot or rocker arm 118 is pivotally mounted to a bi-directionally driven hydraulic cylinder 136, the piston rod 138 of which is attached by clevis 140 and pin 142 to the rearwardly disposed portion of arm 118. The oppositely-disposed side of hydraulic cylinder 136 is pivotally mounted between sides 80 and 82 by a pin 144 extending through a coupler 146 and mounted between sides 80 and 82.

With the arrangement shown, as a billet 56 strikes the bifurcate clamp 92 and drives it rearwardly to the position 92' shown in FIG. 3, cam roller 114 will have moved with arms 98 and 100 against cam surface 116 as the shock absorber 110 functions to decelerate billet 56 expending the energy of movement thereof in a "soft" fashion. Hydraulic cylinder 136 then is actuated and rocker arm 118 is pivoted about pin 120 to cause simultaneous movement of the assemblage of clamp 92 and arms 98 and 100 downwardly. As this downward movement ensues, cam roller 114 moves along cam surface 116 to cause the clamping assemblage to pivot about pin 102 moving billet 56 slightly rearwardly as clamp 92 is caused to assume a vertical orientation. At the full upward travel of the piston rod 138 of hydraulic cylinder 136, the forwardly depending engaging or gripper portions 94 of the clamp 92 abuttably engage the top of billet 56 to retain it in position for marking, while the cam roller 114 bears upon cam surface 116 and outermost edges of arms 98 and 100 bearing upon the top and inner face of stop plate 117 further adds to clamping stability and position repeatability. While locked in the clamping position by cylinder 136, an incoming billet 56 would likely cause excessive damage to the system should cylinder 136 fail to release clamp 92 between marking cycles. To provide a failsafe operation of the system in the event of failure of the hydraulic cylinder 136, a bracket 148 is attached to the rearward end of rocker arm 118 and, in turn, is coupled to a helical spring 150 (FIG. 3) the opposite end of which is connected to a bracket 152 extending from side 80. Thus arranged, the spring 150 will cause the system to return to a stand-by orientation as represented in FIG. 5 in the event of hydraulic failure.

Figure 7:
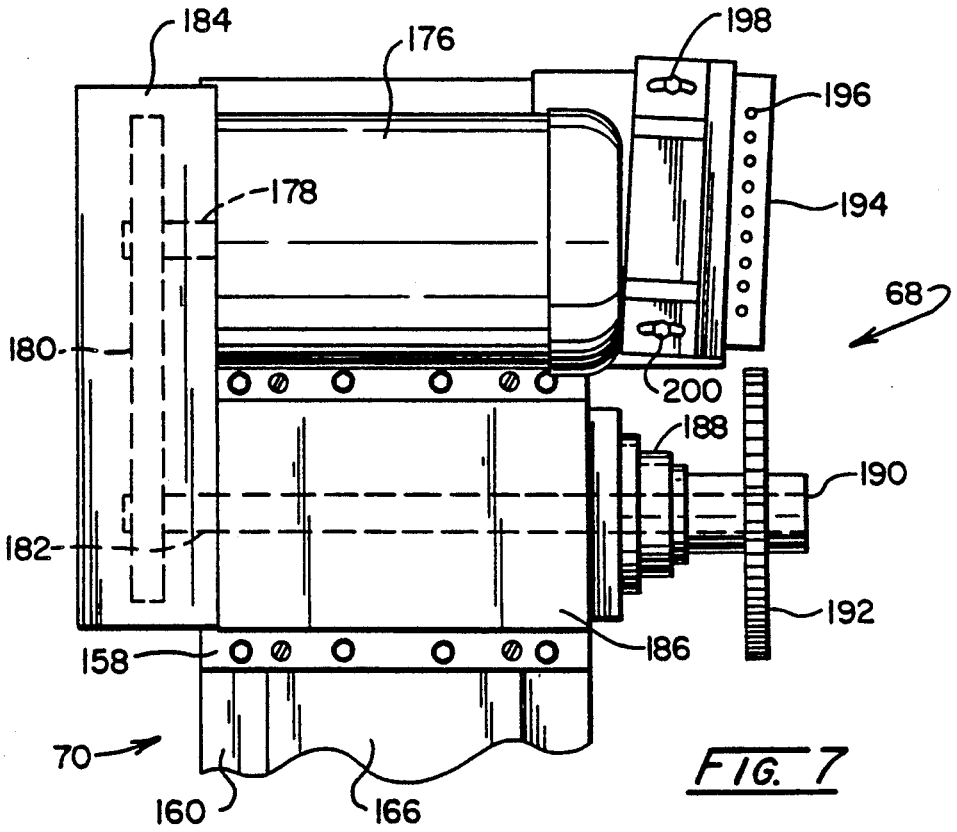
FIG. 7 is a partial side view looking through the plane 7—7 in FIG. 3.
Figure 4:
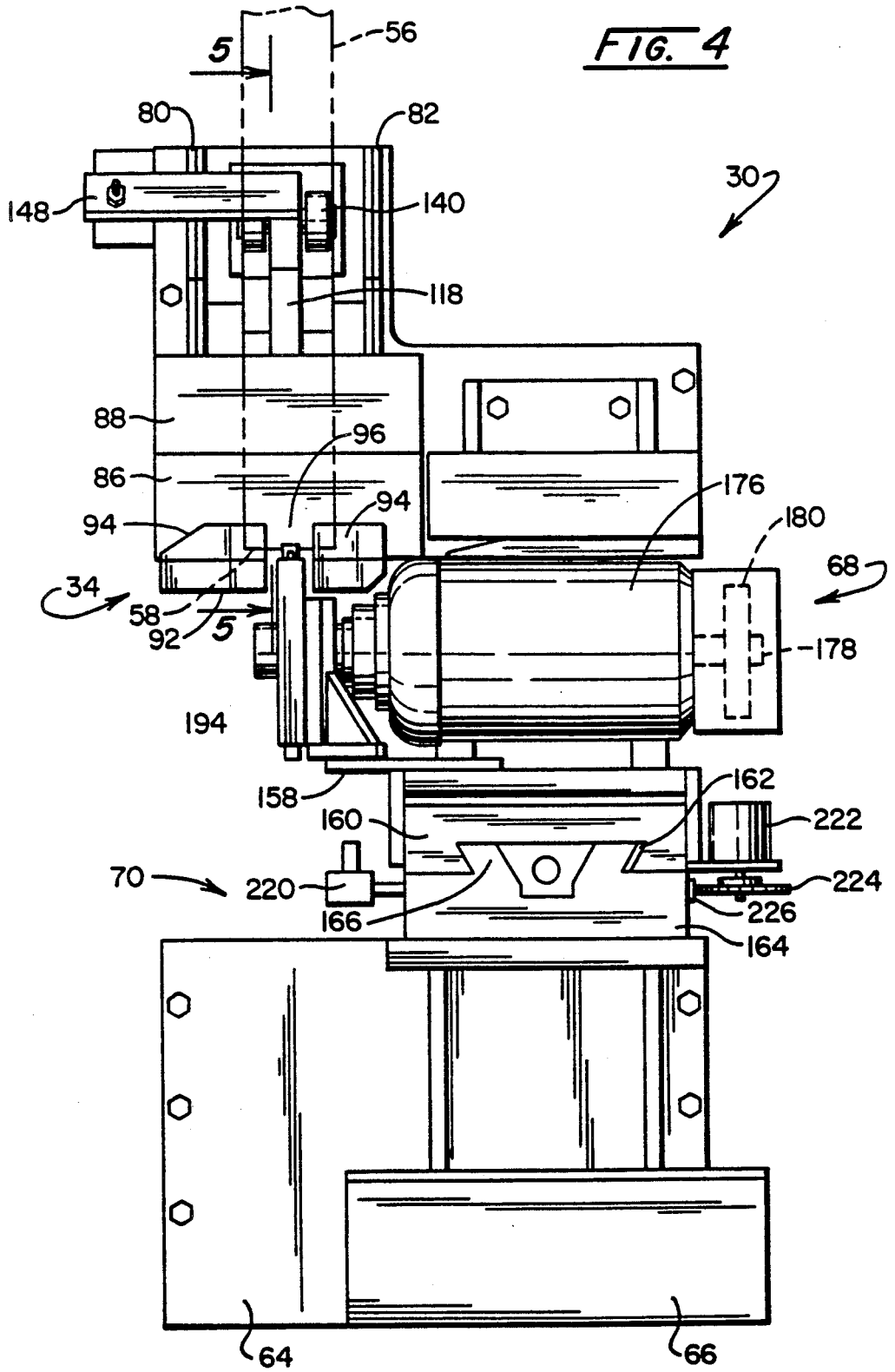
FIG. 4 is a top view of apparatus according to the invention.

Now considering the cutting or milling and marking components 68 of the apparatus 30, reference is made to FIG. 7 where this assemblage is represented in isolated fashion. Assemblage 68 includes a mounting bracket 158 which, in turn, is coupled to the driven carriage 160. FIG. 4 reveals that the driven carriage 160 is configured having a dovetail slidable connection at 162 with a vertically oriented carriage support 164. Support 164, in turn, includes a corresponding dovetail component 166 which slidably engages the slot 162. Thus, the bracket 158 may be maneuvered vertically. Looking to FIG. 3, this movement is seen to be carried out by a bi-directional hydraulic cylinder 170, the piston rod 172 of which is coupled to the driven carriage 160.

Returning to FIG. 7, bracket 158 is seen to support an electric motor 176 having an output shaft 178 connected by belt drive 180 including two pulleys (not shown) to a drive shaft 182. The assemblage of pulleys and belts 180 and shafts 178 and 182 are seen enclosed within a protective housing 184. Shaft 182 is rotatably mounted within a rectangularly shaped housing 186 and extends through a bearing structure 188 to support the hub 190 of a milling or cutting wheel 192. Wheel 192 carries a sequence of replacable cutter elements of rectangular shape having widthwise extents corresponding with the width of the slot desired as represented earlier herein at 54 in connection with FIG. 2. The regularly shaped rectangular cutter components may be formed of an abrasive material, for instance a ceramic or cubic boron nitride coated material selected for the purpose of cutting steel at the elevated temperatures contemplated. Thus, a cutting action as opposed to a grinding action is developed, inasmuch as the hot billet 56 will be relatively soft from the standpoint of forming the slot 54. By forming a regularly shaped rectangular cutter structure, the cutter edges can be rotated such that each of four edges are utilized before replacement or refurbishing is called for. The replaceable cutter components may be provided, for example, as grade CER 2 manufactured by Kyocera Feldmuehle, Inc. Mounted to bracket 158 immediately above cutter wheel 192 and in angularly oriented alignment with its widthwise extent is a marking head 194 carrying an array 196 of nine marker pins. Head 194 is bolted into place in a manner permitting its angular orientation by bolt and arcuate slot connections 198 and 200. The cant or angular orientation of the pin array 196 permits the head structure 194 to carry out marking within the widthwise extent of the slot 54. In general, a nine pin array is utilized for the instant purpose to permit utilization of optical character recognizable (OCR) indicia.

Figure 8:
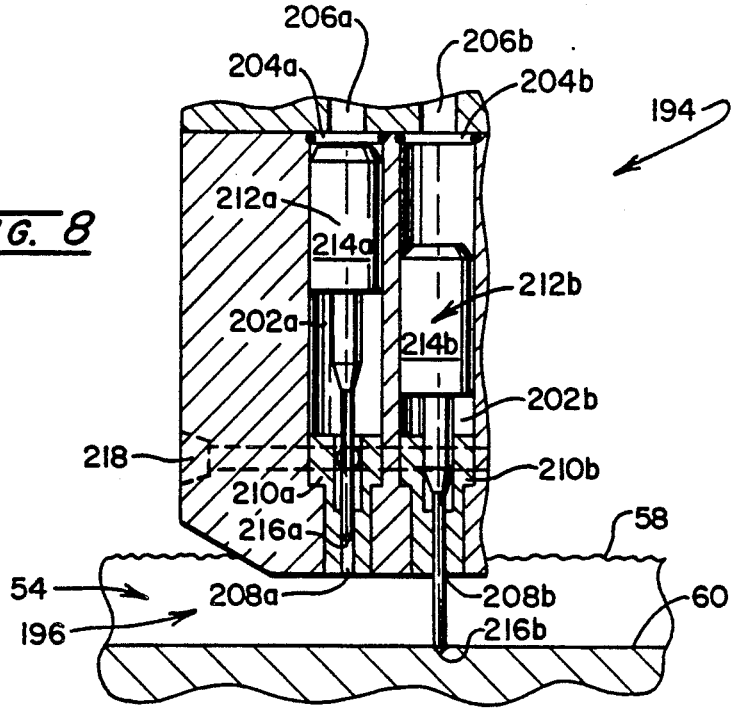
FIG. 8 is a partial sectional view of a component of a marker head employed with the apparatus of the invention.

Referring to FIG. 8, a partial sectional view of the stamping head as at 194 is revealed. This structure represents that disclosed in the above-noted U.S. Pat. No. 4,506,999 which is incorporated herein by reference. As shown in the figure, the head 194 is comprised of a linear array of pin chambers, two of which are revealed generally at **202*a* and 202*b*. These chambers extend upwardly to O-ring containing openings shown, respectively at 204*a* and 204*b* which, in turn, communicate with a pneumatic pressurized air input conduit as represented respectively at 206*a* and 206*b*. Chambers 202*a* and 202*b* extend downwardly to exposed openings of restricted diameter shown, respectively at 208*a* and 208*b*, which are further defined by internally disposed inserts shown, respectively at 210*a* and 210*b***.

Within each of the chambers **202*a* and 202*b* there respectively is positioned a marker pin 212*a* and 212*b*. These pins are seen to have a piston portion shown respectively at 214*a* and 214*b*, and from these piston portions, the pins extend with diminishing diametric extent to a marking tip shown, respectively, at 216*a* and 216*b*. The pins as at 202*a* and 202*b* are returned to the upwardly disposed position shown with respect to pin 202*a* by a return pneumatic pressure emanating from a conduit 218 and extending to the lower region of each of the chambers. Thus, by computer control lead actuation of appropriate valving, the pins can be driven into the surface 60 from a head position disposed outwardly of the cut-off surface 58 of billet 56**.

In the course of general operation of the device 30, a billet as at 56 is expressed from the throat of the caster facility 12 and is directed to the entering platform of device 30. At this point in time, the marking and milling component 68 is in its initial or stand-by position as represented at the elevated location shown in FIG. 3. As the base 58 of billet 56 strikes the stop assembly 34 and is decelerated by the shock absorber 110 action, the heated presence of the billet is detected by a heat responsive sensor such as the infra-red (IR) detector 220 mounted and extending from the carriage support 164 and aimed, for example, at the slot 96 between the bifurcate clamp 92. The use of a thermal device is both convenient from the standpoint that the billets are quite hot, in the range of 1800° F. to 2000° F. and should an accident occur wherein a cold workpiece were to engage the stop, the IR detector would not respond to it. It may be recalled in this regard that the milling wheel 192 cutters are designed for cutting softer, very hot steel. The system must respond to the presence of the billet 56 within a short window of available time to mark, for example about 22 seconds. Accordingly, the clamping activity ensues immediately and the marking and milling assembly 68 then is activated, the milling wheel 192 being turned on and the assemblage 68 is moved rapidly into a position for commencement of cutting slot 54 (FIG. 2). As cutting commences, the speed of the assemblage is adjusted to that which is optimum for the cutting procedure. At the completion of cutting, downward movement continues at a higher rate until the marking head 194 is in position for marking. Movement then continues at a speed optimum for marking and the head 194 carries out a marking procedure identifying the billet 56 with indicia as at 62. At the completion of marking, assemblage 68 again is accelerated to move into a lower completed or "away" orientation shown in FIG. 3 in phantom and with primed numeration. Clamp 92 then is released and the billet is pushed by the pusher assemblage 36 into transfer station or region 50. Assembly 68 then returns to its initial position. The instantaneous position of assemblage 68 is continuously tracked by an encoder revealed in FIG. 4 at 222. Encoder 222 is seen to be mounted upon the driven carriage 160 and incorporates a sprocket 224 which is rotated by virtue of its engagement with a vertically disposed rack 226 fixed to carriage support 164. Limit switches (not shown) also are employed for this purpose. Suitable shielding (not shown) is provided to insulate the encoder 222 from radiant heat since the components to be marked are at elevated temperature.

Figure 9:
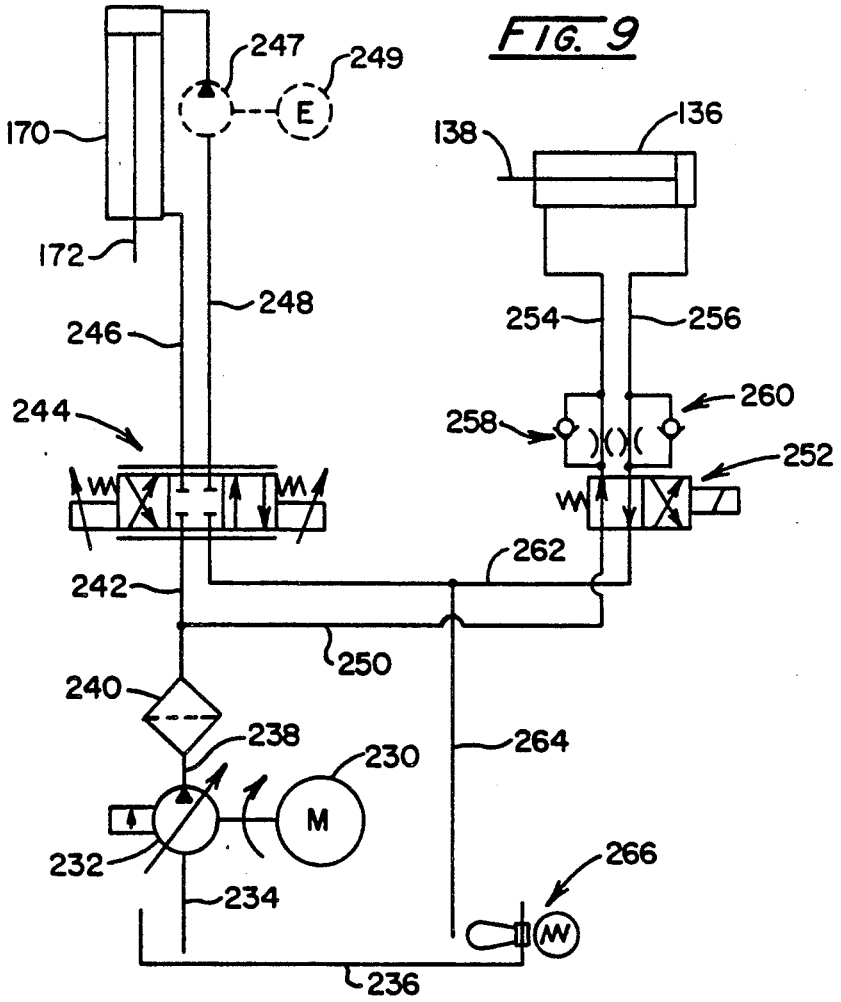
FIG. 9 is a hydraulic schematic diagram of certain functions of the control system of the invention.

Referring to FIG. 9, a hydraulic circuit diagram as associated with the device 30 is revealed. In the figure, a motor 230 is seen operatively coupled with a variable displacement pump 232, the input to which, as represented at line 234 is coupled with a hydraulic reservoir schematically represented at 236. The output of pump 232 at line 238 extends through a filter 240 and thence along line 242 to the input of a bi-directional, voltage responsive, variable flow four-way solenoid driven valve 244. Valve 244 functions to bi-directionally operate hydraulic cylinder 170 via lines 246 and 248. It may be recalled that cylinder 170 functions to move the milling and marking assemblage 68. The drive output of pump 232 also is directed via lines 242 and 250 to the input of a bi-directional solenoid actuated valve 252, the output lines of which at 254 and 256 flow through check valve and flow control orifice assemblies shown respectively at 258 and 260 to provide bi-directional drive to clamping cylinder 136. The return line from valves 244 and 252 is shown at 262 extending to line 264, directed, in turn to reservoir 236. The temperature of fluid contained in reservoir 236 is maintained by a heater assemblage represented at 266. As an alternative to the encoding approach previously described, a positive flow device 247 (shown in phantom) may be coupled within the hydraulic fluid drive circuit of cylinder 170. For example, as the cylinder is actuated to drive carriage 160, the fluid path carrying out this task may be directed additionally through the flow device which, in turn, may generate an output or drive an encoder 249 (shown in phantom) coupled to flow device 247.

Figure 10:
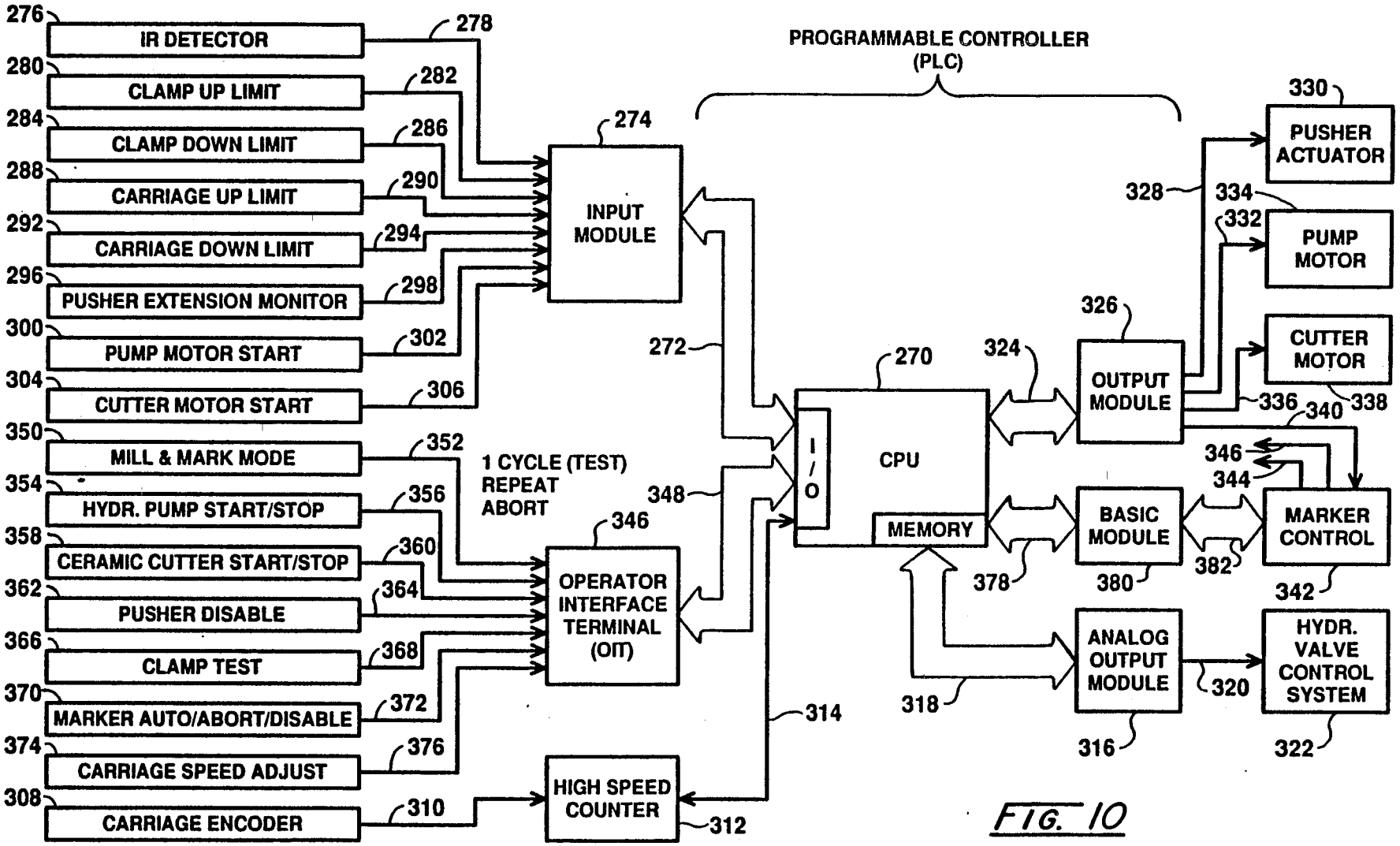
FIG. 10 is a block electrical schematic diagram of the electronic control system employed with the apparatus of the invention.

Referring to FIG. 10, the control system for device 30 is revealed in block diagrammatic fashion. This control system is based upon the utilization of a programmable logic controller (PLC) which may be provided, for example, as a Modicon Model 984 marketed by Gould Electronics Co. Such a controller will include a central processing unit (CPU) as represented at block 270. CPU 270 includes an output (I/O) function which, in turn, is coupled for communication with an input module as represented by bus 272 and block 274. The input module 274 will receive inputs from a variety of status monitoring functions. In this regard, the input showing the presence of billet 56, as detected by heat responsive device 220 is represented by block 276 and line 278. A limit switch having an actuated state when the clamp 92 is in its up vertical and ready state provides an input as represented at block 280 and line 282. Correspondingly, the down position or clamp position for the device 92 is monitored by another limit switch and that switch function as well as its output is represented by block 284 and line 286. The upper terminal or home position for the carriage carrying mill marker assembly 68 is monitored by a limit switch as represented at block 288, the status output thereof being represented at line 290. In similar fashion, the lower position for assemblage 68 as represented in phantom in FIG. 3 is monitored by a limit switch represented at block 292 having a status input to module 274 at line 294. To assure that the billet 56 is clear of the device 30 before moving the marking and milling assembly 68 to its upward or home position from its lowermost "away" position, pusher assembly 36 is monitored by a limit switch determining when it has extended to a position moving the billets to the receiving region 50. This monitoring function is represented at block 296 providing a status input as represented at line 298. The starting of hydraulic pump motor 230 is monitored as represented at block 300 and the status of such start is provided to module 274 as represented at line 302. Similarly, the starting of the cutter motor 176 is monitored as represented at block 304 and the status thereof submitted to module 274 as represented at line 306. Encoder 222 is represented at block 308 as providing an output along line 310 to a high speed counter represented at block 312. This counter provides a binary equivalent input to the CPU 270 when interrogated as represented at line 314.

The command outputs from CPU 270 representing controls to the hydraulic system are directed to an analog output module represented at block 316. The interactive association between module 316 and the CPU 270 is represented at bus 318. Module 316 converts the binary information delivered via bus 318 to a corresponding signal of voltage level varying between zero and 10 volts. This analog output then, as represented at line 320, is directed to the hydraulic valve control system as represented at block 322. With this arrangement, for example, speed control can be asserted through valve 244. Similarly, valve 252 is controllable from control system 322 and the output of module 316.

The output commands from CPU 270 are directed via an interactive bus 324 to an output module represented at block 326. Module 326 develops an appropriately scaled signal to carry out actuations of the pusher assembly 36 as represented by line 328 and block 330; pump motor 230 as represented at line 332 and block 334; cutter motor 176 as represented by line 336 and block 338, and provides a start input to the control of the marker system including head 194 as represented by line 340 and block 342. A marker control 342 as is described in the above referenced U.S. Pat. No. 4,506,999 also provides such logic outputs to input module 274 as a ready-to-print signal represented at line 344 and done signal as represented at line 346.

Operator interaction with the device 30 preferably is provided through an operator interface terminal (OIT) having a color monitor with a menu form of command selection. This function is represented at block 346 which is shown in interactive communication with CPU 270 via a bus as at 348. One available input through terminal 346 is a mill and mark mode selection. This selection as represented by block 350 and line 352 permits the selection of one cycle of device 30 for testing purposes. For this cycle, the carriage assembly with mill and mark components 68 performs from the upper or home position and moves to the lower position shown in phantom in FIG. 3 and remains at that position until instructions are made otherwise. A next mode is referred to as "a repeat cycle" which provides for the normal operation described above wherein the assemblage 68 returns to its home position. A third selection through this feature is that of aborting a cycle. Block 354 and line 356 provide a feature for operator starting and stopping the hydraulic pump motor 230. Similarly, a starting and stopping option for the operator is available with respect to the cutter motor 176 as represented by block 358 and line 360. The operator may disable the pusher assembly 36 through this terminal 346 as represented by block 362 and line 364. The clamping and stop assembly 34 may be tested through terminal 346 as represented by block 366 and line 368 and a control is afforded the operator with respect to the marking function as represented at block 370 and line 372. In the latter regard, the normal operation of the marking system may be elected through an "auto" mode. An abort of a given cycle may be inserted by the opertor and a disable command may be asserted. The speed of the carriage in moving with respect to cutting and marking may be inserted by the operator. Such speed alterations are made in consonance with the hardness of the component being marked as well as with its dimensions. This selective insertion is represented at block 374 and line 376. Character information is delivered from CPU 270 to the Marker Control 342 via bus 378 and a conventional Basic program module 380. An RS232 type coupling as represented by bus 382 provides communication from module 380 to control 342.

Figure 11A:
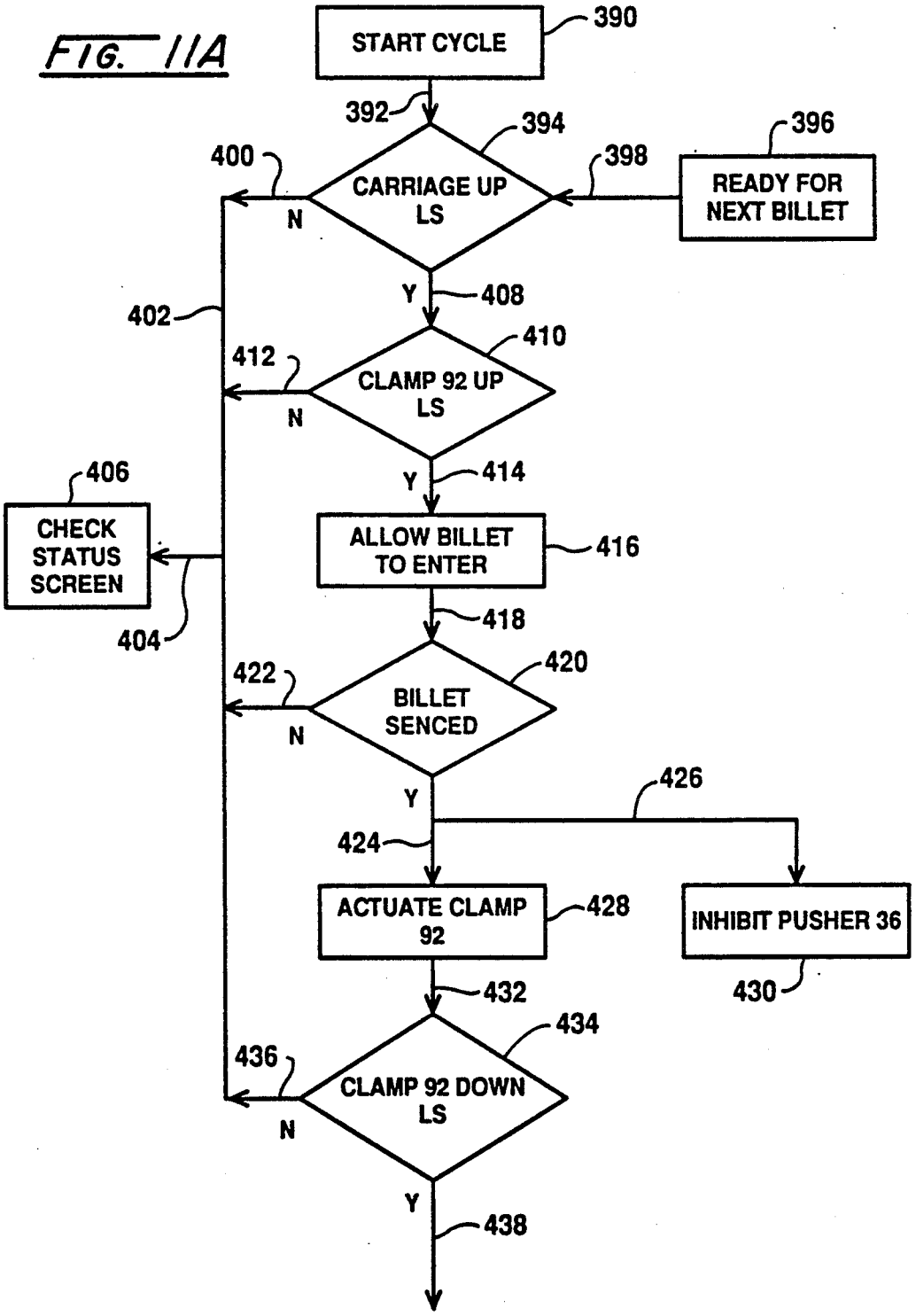
FIGS. 11A–11D combine to form a flow chart describing the control program employed by the control system of FIG. 10.
Figure 11B:
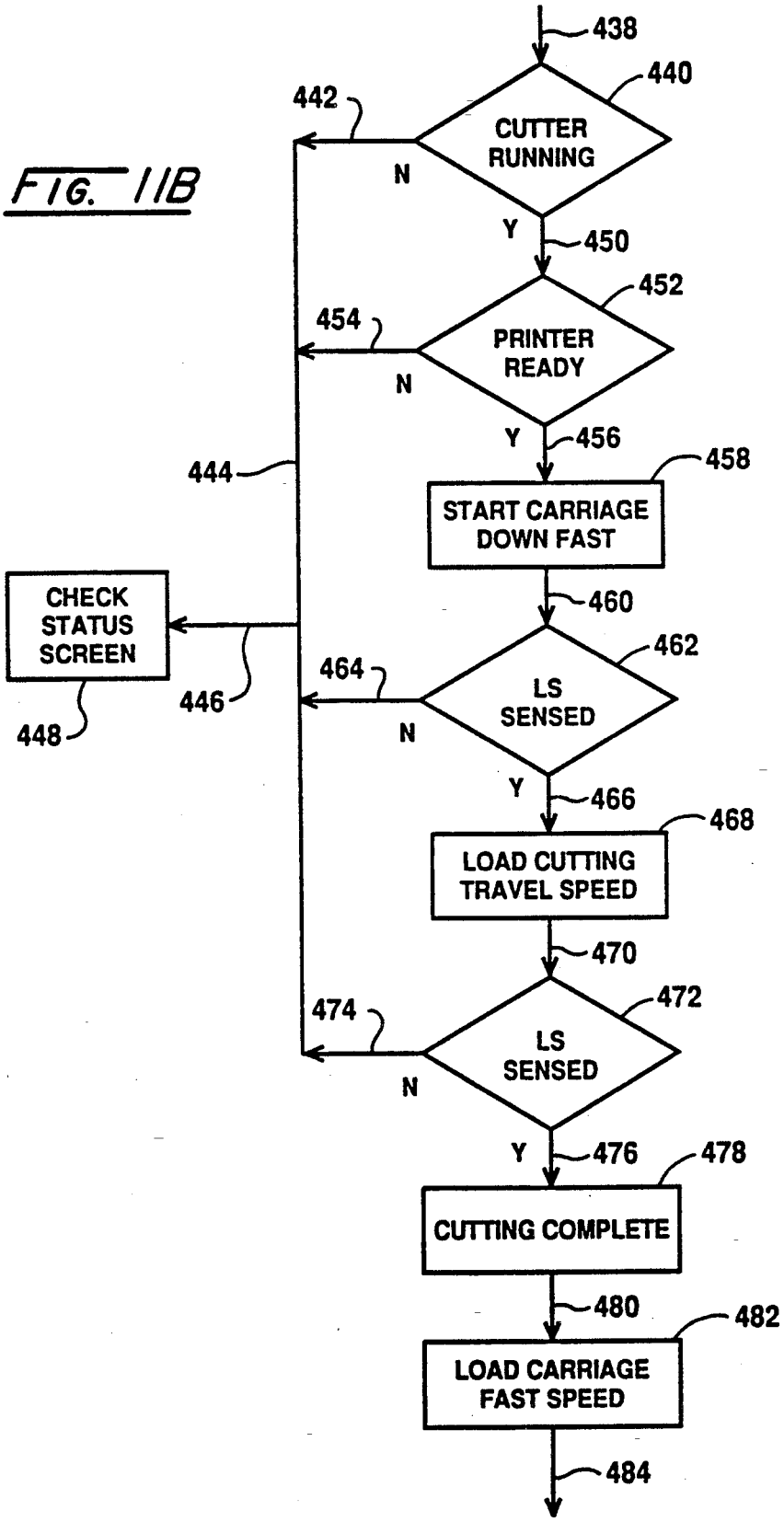
Figure 11C:
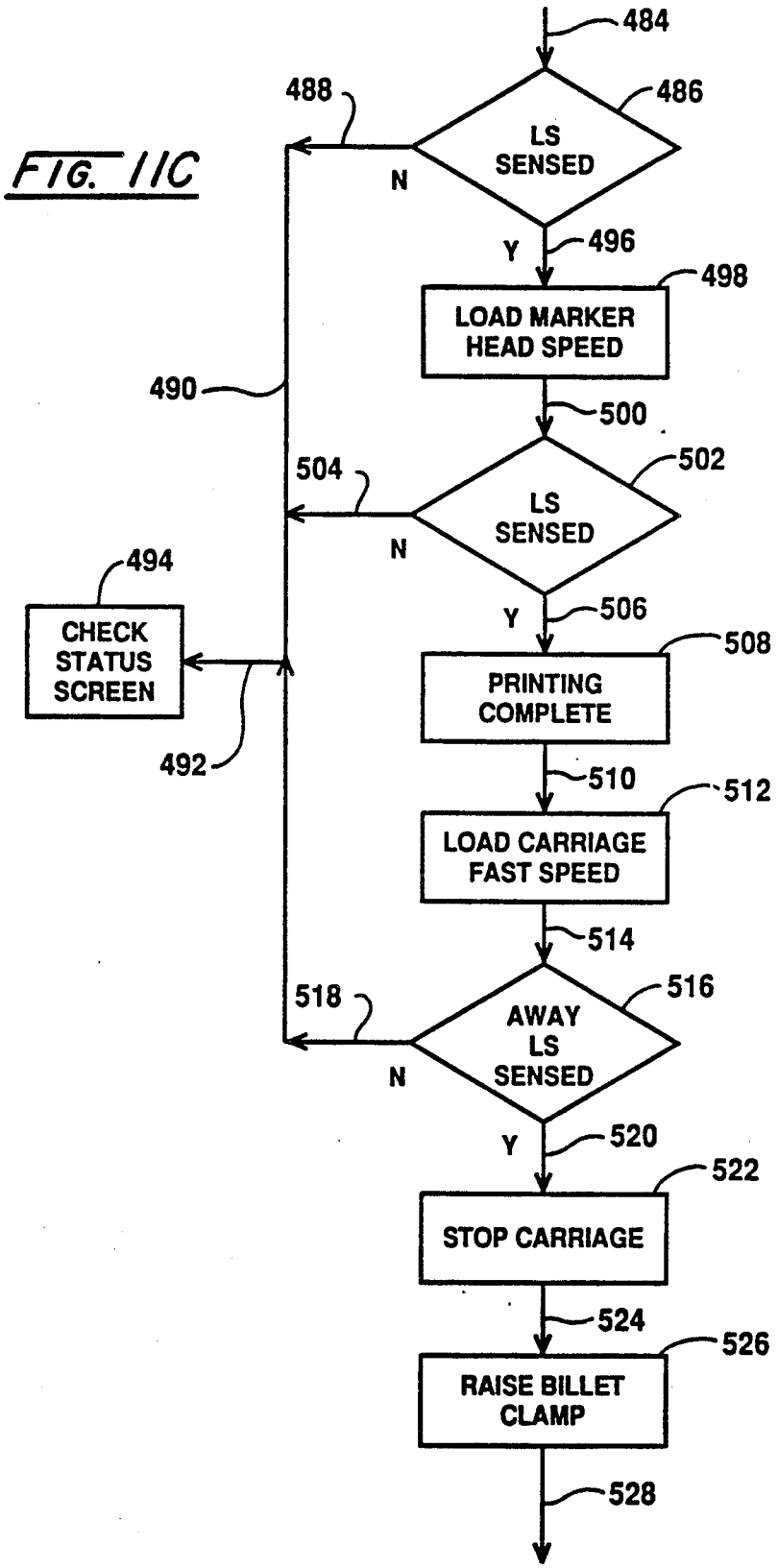
Figure 11D:
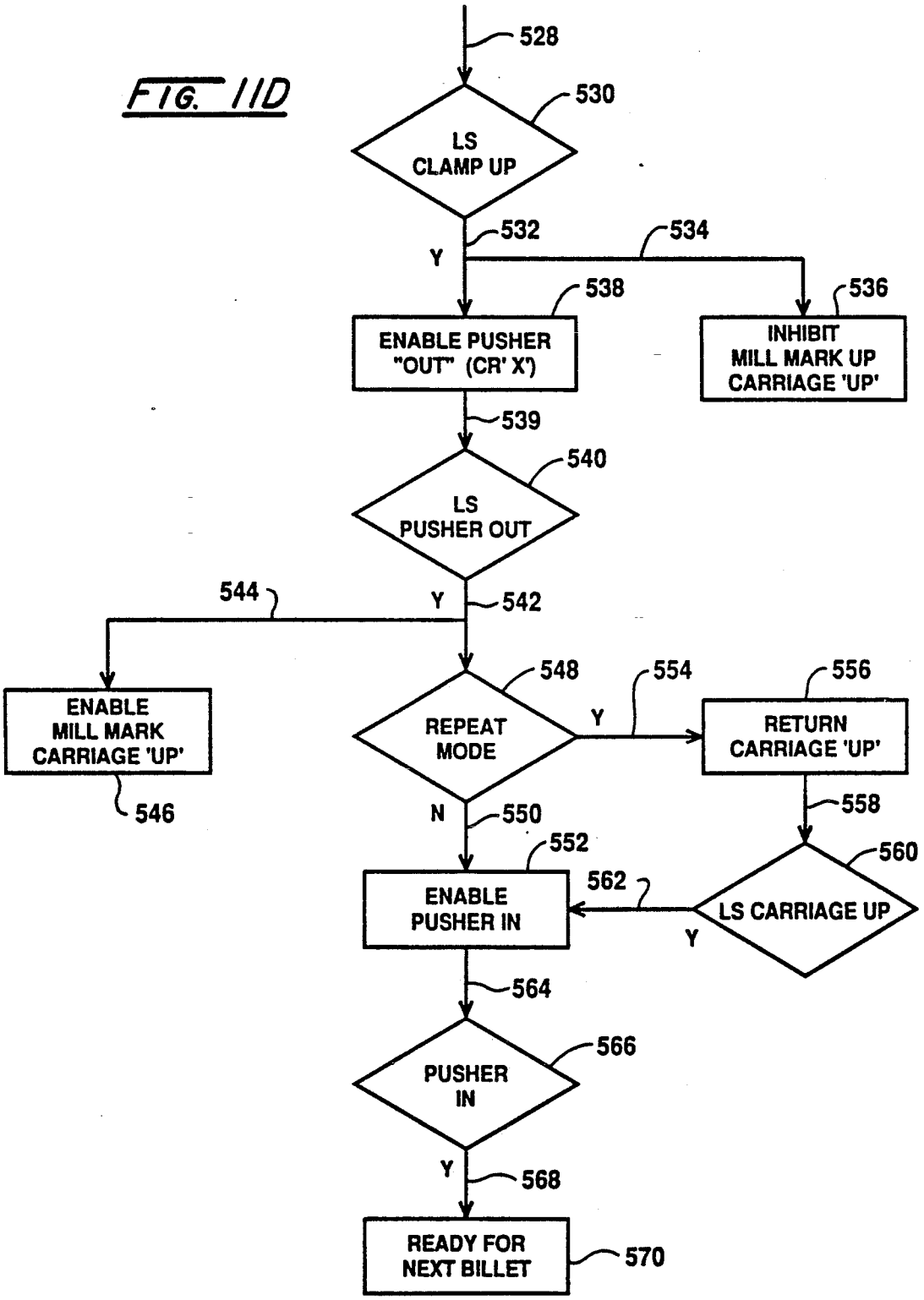

Referring to FIG. 11A, a flow chart representing the principal control activities of CPU 270 is revealed. A given cycle is commenced as represented at node 390 and as represented at lines 392 and 394, the program polls the status of the limit switch representing the position of the carriage 158-marker and milling assemblage 68 status at its home position. This determination is made in conjunction with information that the system is ready for a next billet or component to be marked. The latter information is represented at block 396 and line 398. In the event that the carriage is not in its home position as represented by a limit switch (LS), then as represented at lines 400, 402, 404, and block 406, the control system dwells and a readout is provided at the screen of the operator interface terminal calling for a status check. Where the inquiry at block 394 indicates that the carriage is in its home position, then as represented at line 408 and block 410, a determination is made as to whether the clamp assembly 92 is in its proper up position. In the event that it is not, then as represented at lines 412, 402, 404, and block 406, a dwell condition ensues and the operator is cautioned through a status check informational output. Where an affirmative response is derived from the inquiry at block 410, then as represented at line 414 and block 416, the system permits a billet or component to be marked to enter and impinge upon the clamp assemblage 92. The program then proceeds as represented at line 418 and block 420 to a determination as to whether the billet or component to be marked has been sensed by the heat sensing device 220. Where that sensing output is not received, then as represented at lines 422, 402, 404, and block 406, a dwell condition ensues and a check status indication is made at the operator display. Where the inquiry as represented at block 420 is in the affirmative, then, as represented at lines 424 and 426 leading, respectively to blocks 428 and 430, the clamp structure 92 is actuated to grip the billet or component at the marking station and the pusher assembly 36 is inhibited. The actuation procedure for the clamping assembly 92 requires, for example, about 5 seconds within the short time window permitted for marking. As represented at line 432 and block 434, as the clamp structure as at 92 completes the clamping procedure, a limit switch (LS) is actuated to provide a status so indicated. Where that status of completed clamping is not indicated, then as represented by lines 436, 402, 404, and block 406, the status of a non-clamping condition is displayed to the operator. Where the limit switch status showing that clamping is completed is recognized, then as represented at line 438 and as shown in FIG. 11B, the mill and mark cycle of device 30 is commenced. The initial determination during this cycle is represented at block 440 wherein the system awaits an input indicating that the cutter wheel 192 is running under power from motor 176. Where that is not the case, then as represented at lines 442, 444, 446, and at block 448, the display to the operator indicates that the appropriate status has not occurred. Where a determination is made that the cutter wheel 192 is running, then as represented at line 450 and block 452, an inquiry is made as to whether the printer or marking head 194 and associated control is ready. Where that information is not received, then as represented at lines 454, 444, 446, and block 448, the status is displayed to the operator and the system dwells. Where the inquiry at block 452 shows that the marker head is in a ready condition and a signal has been delivered from the marker control system, then as represented at line 456 and block 458, the carriage 158 is caused to move downwardly under the drive of hydraulic actuator 170 at a rapid speed to minimize time expenditures within the limited window of marking availability. This higher speed occurs until the marking wheel 192 has moved into a location adjacent the billet or component within which a slot is to be cut. The rate of travel during this initial movement may be, for example, 3 inches per second. As the cutter wheel 192 is moved to adjacency with the billet 56, an appropriate limit switch or the output of the encoder 222 will provide an indication of the location being reached where cutting is to commence. This inquiry is represented at block 462. In the event that position has not been reached, then as represented at lines 464, 444, 446, and block 448, the status of the system is reported. Where the location for cutting has been reached, then as represented at line 466 and block 468, the cutting travel speed is loaded such that the carriage moves at a rate optimum for the performance of the cutting wheel 192. This speed is retained until such time as the cutting groove 54 is completed as may be determined by a limit switch or by the output of encoder 222. Such determination is represented by line 470 and block 472. Where that indication has not been received, then as represented at lines 474, 444, 446, and block 448, the cutting status is represented at the display to the operator. However, where an indication is provided that the carriage is at a cutting complete location, then as represented at line 476 and block 478 a status of completion of the cutting of groove 54 is present, and, as represented at line 480 and block 482, the faster carriage speed selected to minimize time again is loaded and the carriage assembly is moved at a time saving faster rate until an indication is received that the marker head 194 is in position to commence marking. Looking to FIG. 11C, this determination is made in conjunction with block 486 wherein the output of the encoder 222 corresponding with this position is detected or an appropriate switch is sensed. Where that location has not been reached, then as represented at lines 488, 490, 492, and block 494, that status is published at the display for the operator and the system awaits the location information required. Where that information is received, then as represented at line 496 and block 498, a command is provided to load the marker head selected speed, whereupon the head 194 is driven along slot 54 at a speed considered optimum for the marking procedure. The program then continues as represented at line 500 and block 502 wherein a determination is made as to whether the carriage 158 is at a position representing a completion of the marking or printing function. Where that is not the case, then as represented at lines 504, 490, 492, and block 494, the status of the marking operation is displayed. Where the system determines that the carriage 158 is at a location representing a completion of printing, then as represented at line 506 and block 508, the control considers the printing to be complete and as represented at line 510 and block 512, the fast speed intended to conserve time again is reasserted or loaded and the carriage 158 moves rapidly to its bottom position away from possible interference with unclamping and billet movement. The program then continues as represented at line 514 and block 516 wherein a determination made as to whether the carriage 158 has reached its lowermost position as represented in phantom in connection with FIG. 3. This position, as before, can be sensed by a limit switch and/or such information may be developed from encoder 222. Where that position has not been reached, then as represented at lines 518, 490, 492, and block 494, the status is published at the display for the operator and the system dwells awaiting receipt of such information. Where the away position has been sensed, then as represented at line 520 and block 522, the carriage 158 is stopped and, as represented at line 524 and block 526, the clamping assemblage 92 is raised by appropriate actuation of hydraulic cylinder 136. The program then continues as represented at line 528 and block 530 as shown in FIG. 11D, upon receiving a status condition from a limit switch associated with the clamp assembly indicating that the clamping structure 92 is at its stand-by releasing position as represented in FIG. 5, then, as represented at lines 532, 534, and block 536, the system is inhibited from permitting the carriage 158 from being moved upwardly towards its home position. Additionally, as represented at block 538, an enabling signal is developed permitting the actuation of pusher assembly 36 to move the billet being marked off of the run-out table 14 and into the transfer station region 50. The program then continues to the inquiry at block 540 wherein a determination is made as to whether the limit switch representing a full extension of the pusher assembly 36 has been actuated. Where that is the case, then as represented at lines 542, 544, and block 546, the system enables the movement of the carriage 158 to its home position. Additionally, the inquiry is made as represented at block 548 determining whether or not the system is in an operator selected repeat mode as discussed in connection with block 350 in FIG. 10. Where a negative determination is made with respect to that inquiry, then as represented at line 550 and block 552, an enabling condition is provided permitting the retraction of pusher assembly 36 to its stand-by or home position. On the other hand, where the determination at block 548 is in the affirmative, then as represented at line 554 and block 556, the carriage is returned to its home or upward orientation. This control then continues as represented at line 558 and block 560 wherein a determination is made as to whether the carriage has reached its upward or home position. As before, this information can be derived from the encoder 222 or from a limit switch. The loop component of the program then continues as represented at line 526 and block 552 to enable the mechanism to draw the pusher mechanism 36 to its return or home position.

The program then continues as represented at line 564 and block 566 to await a status input from a limit switch or the like determining that the pusher assembly 36 has reached its retracted or home position. In the event that it has, then as represented by line 568 and block 570, the control system is in readiness for a next billet marking procedure.

While the home locus of the driven carriage assembly 160 is shown in FIG. 3 as being above the abutting end surface 58 of a metal component to be marked, the home position is not limited to that superior position. A home position might well be located at any locus between the depicted superior position at 160 and the lower pohantom position at 160' as well as in other axes not shown in the accompanying figures.

Since certain changes may be made in the above-described apparatus, system, and method without departing from the scope of the invention herein involved, it is intended that all matter contained in the above description or shown in the accompanying drawings shall be interpreted as illustrative and not in a limiting sense.

We claim:

1. The method of marking metal components in conjunction with their issuance, while at elevated temperature of formation, from a metal component forming system to an initial receiving region, comprising the steps of:

providing a marking station at said receiving region;

detecting the presence of a select surface of said metal component at said station;

milling a groove within said select surface at said marking station while said metal component is at an elevated temperature, said groove having a predetermined width and a depth selected to form a substantially uniform marking surface; and marking said metal component by applying an identifying indicia upon said marking surface.

2. The method of claim 1 in which said step of milling a groove in said select surface is carried out by forming said groove of rectangular cross section employing a rotating milling wheel having abrasive cutter components.

3. The method of claim 1 in which said step of marking said metal component is carried out by moving a marker pin array head assemblage along said groove while forming said indicia as indentations comprising dot matrix formation.

4. The method of claim 1 including the step of clamping and retaining said metal component at said station while said steps of milling and marking are carried out.

5. The method of claim 1 in which:

said step of milling a groove in said select surface is carried out by forming a said groove of rectangular cross section employing a rotating milling wheel having abrasive cutter components; and in which said step of marking said metal component is carried out by moving a marker pin array head assemblage along said groove while forming said indicia as indentations comprising dot matrix formation.

6. The method of claim 1 in which:

said step of milling a groove in said select surface is carried out by forming a said groove of rectangular cross section employing a rotating milling wheel having abrasive cutter components; and including the step of clamping and retaining said metal component at said station while said steps of milling and marking are carried out.

7. The method of claim 1 in which:

said step of marking said metal component is carried out by moving a marker pin array head assemblage along said groove while forming said indicia as indentations comprising dot matrix formation; and including the step of clamping and retaining said metal component at said station while said steps of milling and marking are carried out.

8. The method of claim 1 in which:

said step of milling a groove in said select surface is carried out by forming said groove of rectangular cross section employing a rotating milling wheel having abrasive cutter components;

said step of marking said metal component is carried out by moving a marker pin array head assemblage along said groove while forming said indicia as indentations comprising dot matrix formation; and including the step of clamping and retaining said metal component at said station while said steps of milling and marking are carried out.

9. Apparatus for marking a given surface of metal components at elevated temperatures as they are transferred to a receiving region having a terminus, comprising:

a stop assembly positioned adjacent said receiving region terminus for receiving a metal component in adjacency to position said given surface at a marking location;

a carriage assembly mounted in spaced adjacency to said stop assembly and movable along said marking location between first and second positions;

a milling cutter mounted upon and movable with said carriage assembly and having a movable cutter component of predetermined width operably engageable with said given surface when said carriage assembly is moved from said first to said second positions and said metal component is at said elevated temperature to form a marking groove therein, when actuated, having a substantially uniform marking surface;

a marker assembly mounted upon said carriage assembly, movable therewith along said marking location, and actuable for marking predetermined indicia upon said marking surface;

drive means actuable for effecting said carriage assembly movement; and control means for selectively actuating said drive means, said milling cutter and said marker assembly.

10. The apparatus of claim 9 in which:

said carriage assembly first position is located to position said milling cutter and marker assembly at one side outwardly of said stop assembly; and said carriage assembly second position is located to position said milling cutter and said marker assembly at an opposite side outwardly of said stop assembly.

11. The apparatus of claim 10 in which said milling cutter is mounted upon said carriage assembly preceding said marker assembly.

12. The apparatus of claim 11 in which said control means selectively actuates said drive means to move said carriage assembly from said first to said second positions subsequent to receipt of said metal component given surface at said marking location and actuates said drive means to move said carriage assembly from said second to said first position subsequent to removal of said metal component from said stop assembly.

13. The apparatus of claim 12 in which said carriage assembly is mounted for vertical movement, said first position is above said stop assembly, and said second position is below said stop assembly.

14. The apparatus of claim 12 in which said marker assembly comprises an array of pneumatically actuated marker pins.

15. The apparatus of claim 9 in which said control means includes a thermally activated switch for detecting the presence of said metal component at said marking location.

16. The apparatus of claim 9 in which said stop assembly comprises:

a clamping component movable into and out of engaging abutment with said metal component when said given surface is at said marking location; and a hydraulic actuator assembly responsive to said control means for moving said clamping component.

17. The apparatus of claim 16 in which:

said clamping component is pivotally mounted at said stop assembly for abutable engagement and pivotal movement with said metal component;

including shock absorber means engageable with said clamping component to effect a controlled deceleration of said clamping component and abutting metal component; and said hydraulic actuation assembly is actuable to move said clamping component and said given surface when in abutment therewith into said marking location.

18. The apparatus of claim 17 in which said hydraulic actuator assembly comprises:

a rocker arm pivotally mounted at said stop assembly and providing said pivotal mounting of said clamping component; and a hydraulic cylinder actuable by said control means and having a piston rod coupled with said rocker arm at a location opposite said pivotal mounting with said clamping component.

19. The apparatus of claim 9 in which said control means is responsive to actuate said drive means to move said carriage assembly at a first rate from said first position to a location for effecting said engagement of said milling cutter; is responsive to actuate said drive means to move said carriage assembly at a second rate selected as optimum for the performance of said milling cutter during said formation of said marking groove, is responsive to actuate said drive means to move said carriage assembly at a third rate when said marker assembly is moved along said marking location; and said first rate is selected as higher than said second and third rates.

20. The apparatus of claim 9 wherein:

said drive means includes a hydraulic circuit;

said control means includes a positive displacement flow device coupled within said hydraulic circuit and having an output corresponding with the instantaneous position of said carriage; and said control means is responsive to said output to actuate said drive means.

21. A system for marking steel components upon being expressed at a nascent stage of formation at elevated temperature from a continuous casting facility onto a casting table upon which they are cut to predetermined lengths deriving cut end surfaces and wherein they are pushed from said table by actuation of a pusher assembly, comprising:

a stop assembly positioned at said table at a location for effecting abutting contact with a said steel component and for positioning one of said end surfaces at a marking location;

a carriage assembly mounted in spaced adjacency to said stop assembly and movable between a first position at one side of said stop assembly and a second position at an opposite side of said stop assembly;

a milling cutter mounted upon and movable with said carriage assembly and having a movable cutter component of predetermined width, actuable for operable engagement with said one cut end surface when said carriage assembly is moved from said first to said second position to form a marking groove therein having a substantially uniform marking surface;

a marker assembly mounted upon said carriage assembly, movable therewith along said milling cutter formed marking groove and including an array of marking pins actuable for forming predetermined dot matrix defined indicia upon said marking surface;

drive means actuable for effecting said carriage assembly movement; and control means for selectively actuating said drive means, said milling cutter and said array of marking pins.

22. The system of claim 21 in which:

said carriage assembly first position is located to position said milling cutter and marker assembly at one side outwardly of said stop assembly; and said carriage assembly second position is located to position said milling cutter and said marker assembly at an opposite side outwardly of said stop assembly.

23. The system of claim 22 in which said milling cutter is mounted upon said carriage assembly in a manner to precede said marker assembly.

24. The system of claim 23 in which said control means selectively actuates said drive means to move said carriage assembly from said first position to said second position subsequent to receipt of said steel component at said marking location and actuates said drive means to move said carriage assembly from said second position to said first position subsequent to the removal of said steel component from said stop assembly.

25. The system of claim 21 in which said control means includes a thermally-activated switch for detecting the presence of said steel component at said marking location.

26. The system of claim 24 in which said carriage assembly is mounted for vertical movement, said first position being above said stop assembly and the second position being below said stop assembly.

27. The system of claim 21 in which said stop assembly comprises:

a clamping component movable into and out of engaging abutment with said steel component when said end surface is at said marking location; and a hydraulic actuator assembly responsive to said control means for engaging and disengaging said clamping component.

28. The system of claim 27 in which:

said clamping component is pivotally mounted at said stop assembly for abutable engagement and pivotal movement with said steel component;

including shock absorber means engageable with said clamping component to effect a controlled deceleration of said clamping component and abutting steel component; and said hydraulic actuator assembly actuable to move said clamping component and said steel component end surface when in abutment therewith into said marking location.

29. The system of claim 28 in which said hydraulic actuator assembly comprises:

a rocker arm pivotally mounted at said stop assembly and providing said pivotal mounting of said clamping component; and a hydraulic cylinder actuable by said control means and having a piston rod coupled with said rocker arm at a location opposite said pivotal mounting with said clamping component.

30. The system of claim 21 in which said control means is responsive to actuate said drive means to move said carriage assembly at a first rate from said first position to a location for effecting said engagment of said milling cutter; is responsive to actuate said drive means to move said carriage assembly at a second rate selected as optimum for the performance of said milling cutter during said formation of said marking groove; is responsive to actuate said drive means to move said carriage assembly at a third rate selected as optimum for the performance of said marker assembly during the application of said dot matrix indicia; and said first rate is selected as higher than said second and third rates.

31. The system of claim 21 in which said control means is responsive to said carriage assembly movement into said second position to effect said actuation of said pusher assembly to move from an initial position to remove said steel component from said casting table; and is responsive to said pusher assembly return to said initial position to actuate said drive means to move said carriage assembly to said first position.

32. The system of claim 31 in which said control means is responsive to disable said pusher assembly while said drive means is actuated to move said carriage assembly from said first position to said second position and from said second position to said first position.

* * * * *